US006223442B1

(12) United States Patent
Pina

(10) Patent No.: US 6,223,442 B1
(45) Date of Patent: May 1, 2001

(54) NON-MOTORIZED RAZOR WITH SPRING-SUPPORTED HEAD

(76) Inventor: William Alvarez Pina, 10719 Rambling Trail, Houston, TX (US) 77089

( * ) Notice: Subject to any disclaimer, the term of this patent is extended or adjusted under 35 U.S.C. 154(b) by 0 days.

(21) Appl. No.: 09/377,098

(22) Filed: Aug. 19, 1999

(51) Int. Cl.[7] ..... B26B 21/52
(52) U.S. Cl. ..... 30/527; 30/50; 30/526
(58) Field of Search ..... 30/47, 50, 526, 30/527

(56) References Cited

U.S. PATENT DOCUMENTS

| | | | | |
|---|---|---|---|---|
| 1,015,575 | * | 1/1912 | Meyer | 30/527 |
| 3,311,975 | * | 4/1967 | Longuyon | 30/526 |
| 4,791,724 | * | 12/1988 | Dumas | 30/526 |
| 5,038,472 | * | 8/1991 | Iderosa | 30/527 |
| 5,678,316 | * | 10/1997 | Althaus et al. | 30/527 |
| 5,813,293 | * | 9/1998 | Apprille, Jr. et al. | 30/526 |
| 5,953,825 | * | 9/1999 | Christman et al. | 30/527 |

* cited by examiner

*Primary Examiner*—Hwei-Siu Payer
(74) *Attorney, Agent, or Firm*—Kenneth A. Roddy

(57) ABSTRACT

A non-motorized razor has a rigid handle, a thin resilient leaf spring of flat cross section supported at a first end on the handle having a free end portion extending outwardly therefrom, and a generally rectangular blade-carrying razor head attached transversely at its approximate center on the free end portion of the spring in a plane approximately tangent to the plane of the spring with its lateral ends extending laterally outwardly therefrom. The spring free end portion is resiliently flexible in vertical and horizontal planes and capable of twisting along its central longitudinal axis to enable spring-biased movement of the razor head with the free end portion in arcuate vertical and horizontal paths relative to the handle, and spring-biased twisting movement of the razor head lateral ends in diametrically opposed arcuate paths about the central longitudinal axis of the spring and axis of the handle. An adjustment mechanism may be provided for selectively extending and retracting the spring free end portion relative to the handle to increase or decrease its effective length and thus the associated resilient spring action and twisting action of the spring and movement of the head.

21 Claims, 10 Drawing Sheets

NON-MOTORIZED RAZOR WITH SPRING-SUPPORTED HEAD

BACKGROUND OF THE INVENTION

1. Field of the Invention

This invention relates generally to non-motorized razors, and more particularly to a hand-held razor having a spring connection between the razor handle and the razor head that allows spring-biased universal movement of the head, and to such a razor having an adjustment mechanism for selectively adjusting the resiliency of the spring member by increasing or decreasing its effective length.

2. Brief Description of the Prior Art

Inexpensive disposable and non-disposable razors are popular items in today's marketplace. Most commercially available disposable razors have a molded plastic handle with an integrally molded cartridge or head at one end having one or more blades mounted therein. The cartridge or head is integrally molded at a fixed angle relative to the longitudinal axis of the handle and is incapable of relative movement. Most commercially available non-disposable razors have a handle with an integral neck portion at one end that is adapted to be releasably attached to a separate replaceable blade-holding cartridge by a snap-fit or sliding-fit arrangement. The replaceable cartridge is attached at a fixed angle relative to the razor handle, and is also incapable of relative movement.

More recently, inexpensive razors have been introduced wherein the cartridge or head is pivotally connected to the handle to pivot about a plane transverse to the longitudinal axis of the handle. The Gillette Company markets several such razors. One recent model has been recently introduced under the trademark "Mach 3" which is shown and described in detail in U.S. Pat. Nos. 5,784,790 and 5,787,586 which are hereby incorporated by reference.

There are several other patents that disclose razor structures having a pivotal or resilient connection between the razor handle and razor head.

Iderosa, U.S. Pat. No. 5,038,472 discloses a pivoting safety razor assembly having spaced upper and lower corrugated flexures connected at one end to the handle and converging outwardly therefrom with a blade holding cartridge fixed at their outer ends such that their respective planes intersect in a line at the cutting edge of the blade(s) to provide rotational movement of the handle about the cutting edge. To mechanically limit rotational movement between the handle and the blade device, one end of a rigid guide pin is fixedly attached to the blade device and its other end is slidably engaged with the handle, or a wedge is disposed between the between the flexures.

Armbruster et al, U.S. Pat. No. 5,560,106 discloses a plurality embodiments of a razor having downwardly curved razor head with a generally cylindrical or oval-shaped resilient bushing-like member of fixed length secured at each end between the razor handle and the razor head which enables the razor head to move in all directions or in the X, Y and Z planes. In one embodiment, the cylindrical resilient member is mounted on a flexible shaft connecting the head with the handle and the end portion of the handle is externally threaded and provided with a threaded nut that compresses or squeezes the cylindrical resilient member to vary the resilient characteristics of the resilient member.

Olson, U.S. Pat. No. 5,600,887 discloses a flexible easy-rinsing razor having a handle, a flexible neck coupled to the handle, and a pair of mounting arms extending from the neck and securing the lateral ends of a blade cartridge. The flexible neck can be protracted into and retracted from the handle by turning a rotatable cuff coupled to the handle. The razor may also be provided with a flume attached to the flexible neck that is capable of directing a rectangular-shaped water stream through the blade cartridge Althaus et al, U.S. Pat. No. 5,678,316 discloses a disposable razor handle having an integrally formed resilient neck portion of fixed length that curves outwardly and downwardly from the handle portion and has an outer end adapted to receive a blade unit. The curved neck portion is formed of an arcuate layer of relatively inflexible plastic on the tension side (underside) and an arcuate layer of soft flexible material such as rubber on the compression side (top side) joined together with the flexible material extending through the length of the plastic handle. The double-material arcuate curved portions have an upstanding central rib with lateral side portions of s-shaped wave or serpentine configuration along its length.

The prior art listed above includes various structures that enable relative movement of the razor head in relation to a rigid handle.

Althaus, U.S. Pat. No. 5,001,832 discloses a razor blade unit having at least one freely rotatable cylindrical roller that extends parallel to the cutting edge of the razor blade to engage a skin area, but does not suggest relative movement of the razor head in relation to a handle.

The present invention is distinguished over the prior art in general, and these patents in particular by a non-motorized razor having a rigid handle, a thin resilient leaf spring of flat cross section supported at a first end on the handle with a free end portion extending outwardly therefrom, and a generally rectangular blade-carrying razor head attached transversely at its approximate center on the free end portion of the spring in a plane approximately tangent to the plane of the spring with its lateral ends extending laterally outwardly therefrom. The spring free end portion is resiliently flexible in vertical and horizontal planes and capable of twisting along its central longitudinal axis to enable spring-biased movement of the razor head with the free end portion in arcuate vertical and horizontal paths relative to the handle, and spring-biased twisting movement of the razor head lateral ends in diametrically opposed arcuate paths about the central longitudinal axis of the spring and axis of the handle. An adjustment mechanism may be provided for selectively extending and retracting the spring free end portion relative to the handle to increase or decrease its effective length and thus the associated resilient spring action and twisting action of the spring and movement of the head.

SUMMARY OF THE INVENTION

It is therefore an object of the present invention to provide a razor having a resilient leaf spring cantilevered at one end to a rigid handle and a rigid blade-carrying head attached at the free end of the spring wherein the leaf spring is capable of flexing and twisting along its longitudinal axis.

It is another object of this invention to provide a razor having a resilient leaf spring cantilevered at one end to a rigid handle and a rigid blade-carrying head attached at the free end of the spring wherein the razor head is attached approximately tangent to the plane of the free end of the spring such that its blade-carrying side is pulled across the skin surface under resilient spring resistance, rather than being pushed.

Another object of this invention is to provide an adjustable razor having a resilient leaf spring cantilevered at one end to a rigid handle and a rigid blade-carrying head attached at the free end of the spring wherein the head is capable of movement in all directions relative to the handle and the effective length of the leaf spring is selectively adjustable by the user to vary the amount of spring resiliency and head movement to the desired level for a particular skin surface or area being shaved.

Another object of this invention is to provide a razor having a resilient leaf spring cantilevered at one end to a rigid handle and a rigid blade-carrying head attached at the free end of the spring which will accurately and smoothly follow the contours of the skin surfaces being shaved, and is easily maneuvered over contoured and hard to reach areas such as over the jaw bone and cheeks, around the mouth, beneath the nose, and contoured underarm and surfaces.

Another object of this invention is to provide a razor having a pair of resilient spring elements each cantilevered at one end to a rigid handle and a rigid blade-carrying head attached at the free ends of the spring elements wherein each spring element is capable of flexing and twisting along its longitudinal axis.

Another object of this invention is to provide a razor having a resilient spring cantilevered at one end to a rigid handle and a rigid blade-carrying head attached at the free end of the spring, which can be easily assembled.

A further object of this invention is to provide a razor having a resilient leaf spring cantilevered at one end to a rigid handle and a rigid blade-carrying head attached at the free end of the spring that will reduce nicks and cuts, and skin irritation.

A still further object of this invention is to provide a razor that can be manufactured inexpensively as a disposable or non-disposable razor and with a permanent blade-carrying head or with replaceable heads or cartridges.

Other objects of the invention will become apparent from time to time throughout the specification and claims as hereinafter related.

The above noted objects and other objects of the invention are accomplished by a non-motorized razor having a rigid handle, a thin resilient leaf spring of flat cross section supported at a first end on the handle with a free end portion extending outwardly therefrom, and a generally rectangular blade-carrying razor head attached transversely at its approximate center on the free end portion of the spring in a plane approximately tangent to the plane of the spring with its lateral ends extending laterally outwardly therefrom. The spring free end portion is resiliently flexible in vertical and horizontal planes and capable of twisting along its central longitudinal axis to enable spring-biased movement of the razor head with the free end portion in arcuate vertical and horizontal paths relative to the handle, and spring-biased twisting movement of the razor head lateral ends in diametrically opposed arcuate paths about the central longitudinal axis of the spring and axis of the handle. An adjustment mechanism may be provided for selectively extending and retracting the spring free end portion relative to the handle to increase or decrease its effective length and thus the associated resilient spring action and twisting action of the spring and movement of the head.

DESCRIPTION OF THE PREFERRED EMBODIMENTS

Figure 1:
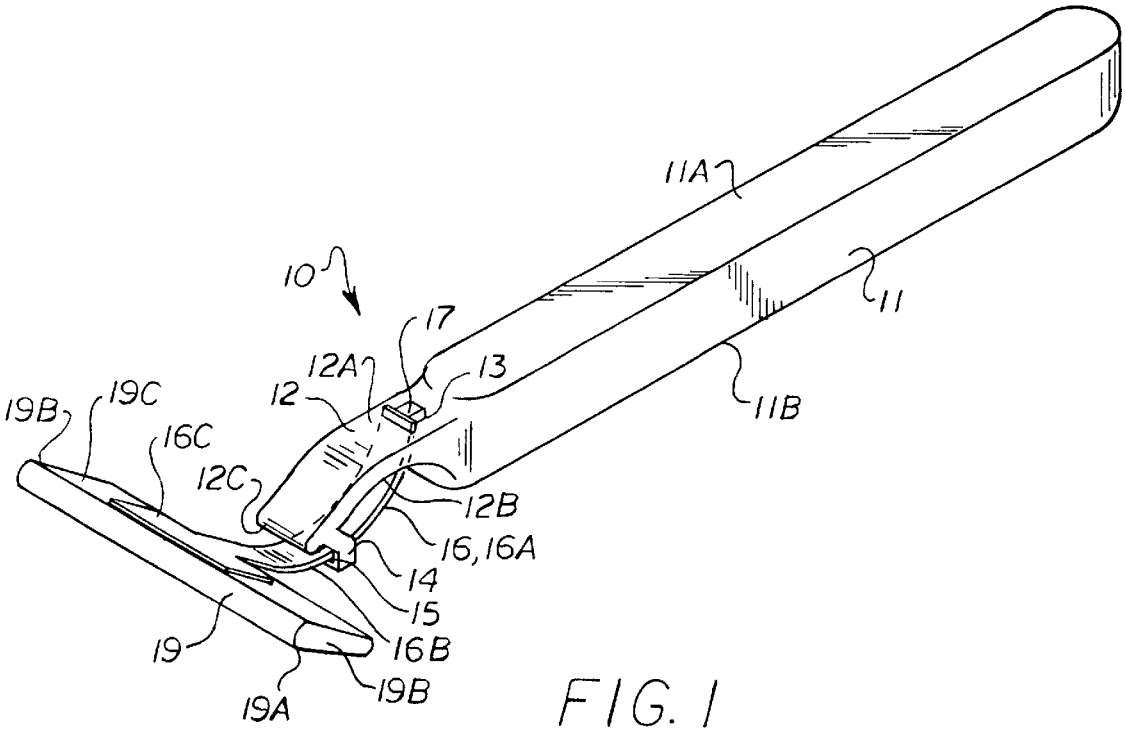
FIG. 1 is a perspective view of a first embodiment of an adjustable razor with a spring-supported head in accordance with the present invention having a push-type adjustment mechanism.

In the following discussion, it should be understood that the present razors may be disposable or non-disposable type razors and that the blade-holding member may be furnished as separate replaceable blade cartridges or furnished as an integral component of the razor.

Referring to the drawings by numerals of reference, there is shown in FIGS. 1 through 6, a first preferred embodiment of an adjustable razor 10 having a spring-supported head and a push-type adjustment mechanism. The razor 10 has an elongate rigid handle 11 which may be of any conventional shape and configuration. One end of the handle 11 has an integral generally rectangular curved neck portion 12 which is reduced in thickness that extends outwardly from the topside 11A of the handle 11 and curves downwardly in the direction of its underside 11B.

A polygonal slot 13 extends through the curved neck portion 12 from its topside 12A to its underside 12B. A pair of generally L-shaped flanges 14 formed on the underside 12B of the curved neck portion 12 near its outer end 12C depend from the underside in laterally opposed relation with their lower legs facing inward and spaced a short distance therefrom to define a longitudinal slot 15 therebetween.

An elongated curved thin rectangular leaf spring 16 formed of resilient material having a flat cross section is movably mounted on the curved neck portion. The curved spring may be formed of any suitable resilient material such as plastic or metal. The spring 16 has an elongate longitudinal curved portion 16A that is slidably received though the longitudinal slot 15 defined by the flanges 14, leaving a curved free end portion 16B extending outwardly therefrom. The curved free end portion 16B has a smooth uninterrupted curved surface and a central longitudinal axis extending along a curved plane.

A first small rectangular push element 17 is disposed on the underside of the spring 16 at a first end of the spring. A second small rectangular push element 18 is disposed on the underside of the spring 16 in longitudinally spaced relation a short distance from the first push element 17.

In a preferred embodiment, the thin leaf spring 16 is approximately 3/16" in width and the width of the push elements 17 and 18 are more narrow to define a generally T-shaped cross section at the first end of the spring. The polygonal slot 13 extending through the curved neck portion 12 of the handle 11 is a mating T-shaped channel sized to slidably receive the T-shaped spring 16 and depending push elements 17 and 18. It should be understood, however, that the cross sectional shape formed by the first end of the spring 16 and push elements 17 and 18 and the mating slot 13 may be any suitable configuration to prevent rotation of the portion of the spring extending between the slots 13 and 15. For example, they may be square or rectangular or may be provide mating slots and grooves.

Figure 5:
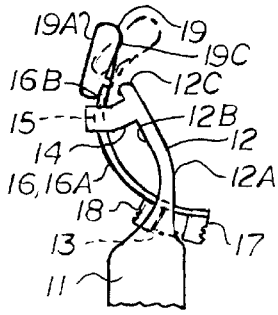
FIG. 5 is a side elevation view of the upper portion of the first embodiment of the adjustable razor, showing the spring member in a fully retracted position.
Figure 3:
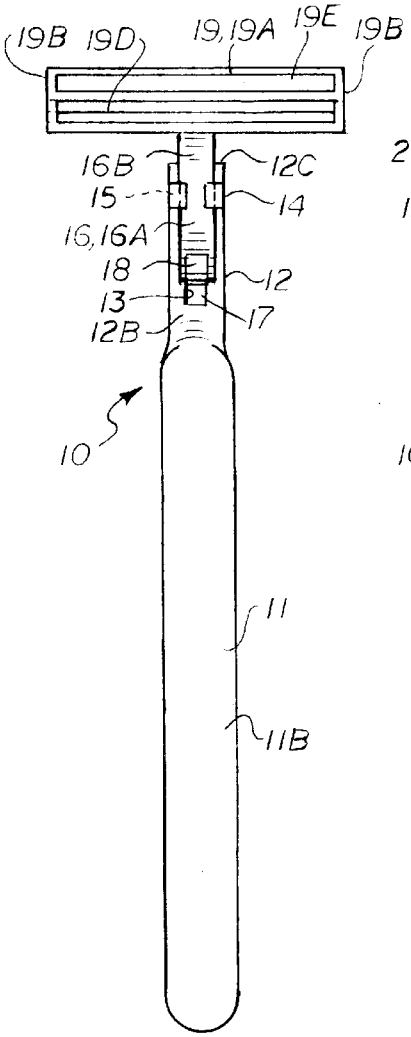
FIG. 3 is a front elevation view of the first embodiment of the adjustable razor.
Figure 2:
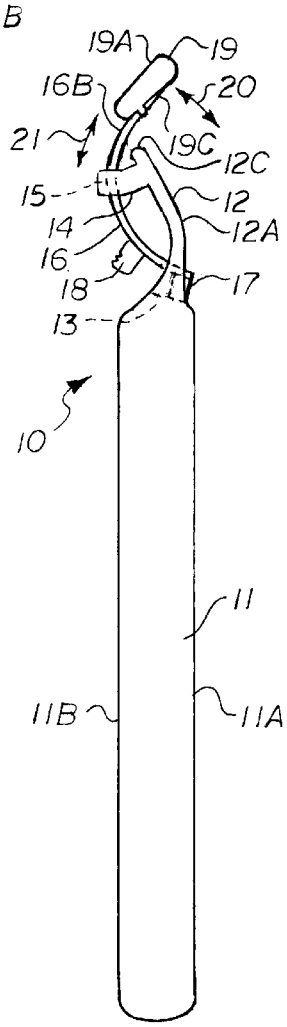
FIG. 2 is a side elevation view of the first embodiment of the adjustable razor, showing the spring member in a fully extended position.

As shown in FIGS. 2 and 5, the push elements 17 and 18 are spaced apart a sufficient distance so that when the spring is in its fully extended position (FIG. 2) the first push element 17 will be generally flush with the topside 12A of the curved neck portion 12 of the handle 11 with the second push element 18 protruding from the neck portion underside 12B, and when the spring is fully retracted the second push element 18 will be generally flush with the underside 12B of the curved neck portion 12 with the first push element 17 protruding from the topside 12A of the curved neck portion (FIG. 5). It should be understood that a single elongate push element may be used wherein its outer ends would alternately protrude or be flush as the spring is extended and retracted.

The elongate longitudinal curved portion 16A of the spring 16 is slidably mounted in the slots 13 and 15 and its curvature is disposed in opposed facing relation to the curvature of the curved neck portion 12. The curved free end portion 16B of the spring 16 extends from the slot 15 in the flanges 14, curves upwardly beyond the outer end 12C of the curved neck portion 12, and terminates in an outermost end 16C.

The outermost end 16C of the free end portion 16B of the spring 16 is adapted for connection to a rigid blade holding cartridge or head 19. The cartridge or head 19 has a longitudinal face or front side 19A, lateral side edges 19B, and a longitudinal backside 19C. The cartridge or head 19 has one or more razor blades 19D mounted therein and may also be provided with a conventional lubricating strip 19E of lubricous material adjacent to the blades. The backside 19C of the cartridge or head 19 is connected transversely at its approximate center in a plane approximately tangent to the curved plane of the free end portion 16B of the spring 16 with its lateral ends 19B extending outwardly from the sides of the spring.

Figure 4:
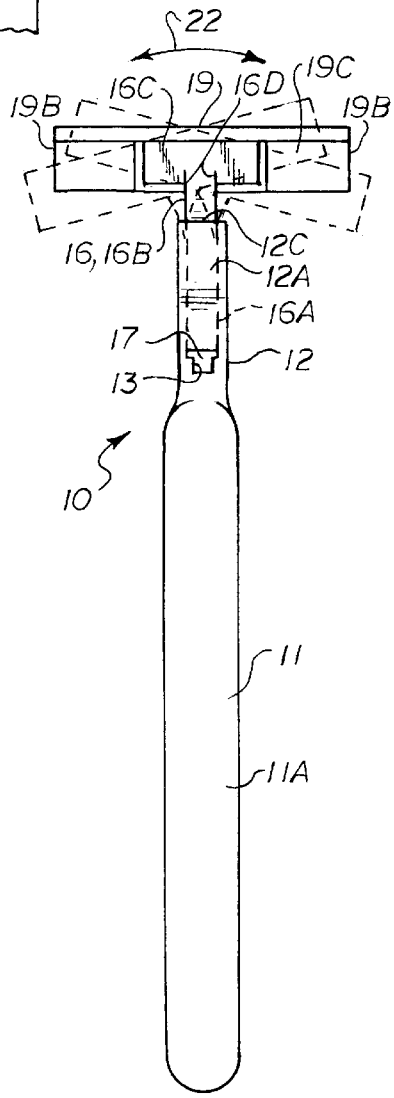
FIG. 4 is a rear elevation view of the first embodiment of the adjustable razor, illustrating the movement of the razor head in dashed line.

In the illustrated example, as seen from the top in FIG. 4, the outermost end 16C of the spring is a flat T-shaped configuration. The spring 16 may be provided with a pair of laterally opposed slots 16D extending into the transverse portion of the T-shape to facilitate movement of the transverse portion of the T-shaped end relative to the longitudinal axis of the spring.

In a disposable razor embodiment, the flat T-shaped outer end 16C of the spring 16 may be fixed to the backside 19C of cartridge or head 19 by a bonding agent or by a heat or sonic welding procedure such that the cartridge or head becomes an integral component of the razor, or may be joined by a snap-fit arrangement. In a non-disposable embodiment, a plurality of replaceable cartridges or heads 19 are provided and the T-shaped outer end 16C of the spring 16 is releasably connected to the backside of a cartridge or head.

This may be accomplished by providing a mating snap-fit arrangement between the backside 19C of the cartridge or head 19 and the spring end 16C such that the cartridge or head can be releasably attached by pressing the spring end 16 onto the cartridge or head. Alternatively, the spring end 16C and backside 19C of the cartridge or head 19 may be provided with a tongue and groove sliding-fit arrangement such that the cartridge or head can be releasably attached by sliding by the end 16C of the spring 16 onto the cartridge or head. It should be understood that the end 16C of the spring may be configured to be releasably attached to the back side of commercially available replaceable cartridges or heads.

The curved free end portion 16B is cantilevered outwardly from the slot 15 and is capable of resiliently flexing in vertical and horizontal planes and twisting along its central longitudinal axis. The resiliency of the spring 16 is adjusted by extending or retracting it axially relative to the curved neck portion 12 of the handle 11. The curved free end portion 16B of the spring 16 may be provided with one or more apertures (not shown) along its length to increase flexibility.

The effective length of the curved free end portion 16B of the spring 16 extending from the slot 15 is adjusted by the user pushing the first push element 17 toward the top side 12A of the neck portion 12 of the handle 11 to extend the spring, or pushing the second push element 18 toward the underside 12B of the neck portion 12 to retract the spring.

Extending the spring 16 increases the effective length of the free end portion 16B and increases the resiliency of the spring, making it more springy, and also increases its twisting action. Retracting the spring shortens the effective length of the free end portion and decreases the resiliency, making it stiffer, and also decreases its twisting action. Thus, the adjustment mechanism allows the user (male or female) to selectively adjust the spring resiliency and head movement to the desired level for the particular skin surface being shaved. For example, a user may want a softer or more resilient setting for shaving the face or certain portions of the face, and a stiffer less resilient setting for shaving the legs.

Figure 6:
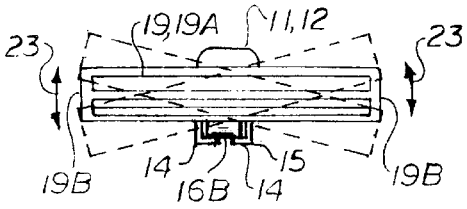
FIG. 6 is a top end view of the first embodiment of the adjustable razor viewing the razor from the top edge of the head and illustrating the movement of the razor head in dashed line.

FIGS. 2, 4 and 6 illustrate schematically, in dashed line, the movement capability of the cartridge or head 19 relative to the handle 11 allowed by the spring 16. As seen from the side in FIG. 2, the cartridge or head 19 can move in an arcuate path with the curved free end 16B of the spring 16 in a vertical plane relative to the longitudinal axis of the handle 11 (up or down as seen from the top side of the handle) as indicated by arrow 20. The length of the arc is controlled by extending or retracting the free end portion 16B of the spring 16 as indicated by arrow 21.

As seen from the top side of the razor in FIG. 4, the free end portion 16C of the spring 16 can also flex laterally slightly to the left or right in a horizontal plane relative to the longitudinal axis of the handle 11 so that the lateral ends of the cartridge or head 19 move in a lateral arcuate path relative to the longitudinal axis of the handle 11, indicated by arrow 22 and dashed line. As seen from the top edge of the cartridge or head 19 in FIG. 6, because the free end 16B of the spring 16 can twist about its longitudinal axis, the lateral ends 19B of the cartridge or head 19 can pivot in diametrically opposed paths relative to the longitudinal axis of the spring and to the longitudinal axis of the handle 11 (arrows 23).

Referring again to FIGS. 1 and 2, it should be noted that the curved free end portion 16B is cantilevered in the slot 15 beneath the longitudinal axis of the handle 11 and curves outwardly and upwardly beyond the outer end 12C of the curved neck portion 12, and the cartridge or head 19 is connected transversely in a plane approximately tangent to the convex (outwardly bowed) side of the curved plane of the free end portion 16B. This mounting arrangement causes the cartridge or head 19 to be pulled across the skin surface rather than being pushed, similar to the way a paint brush is pulled across a surface, and is held against the skin surface by the gentle resilient spring force.

Thus, when the user presses the cartridge or head 19 against the skin surface he or she can manipulate the handle 11 to cause the cartridge or head 19 to move relative to the handle 11 in any direction and in any plane. This allows the cartridge or head 19 to glide smoothly along the contours of the surface being shaved and to be easily maneuvered in hard to reach areas such as over the jawbone and cheeks, around the mouth, beneath the nose, and contoured underarm surfaces. By extending or retracting the spring 16, the user can also selectively adjust the range of motion of the cartridge or head 19 and selectively adjust the resiliency to the desired level for the particular skin surface being shaved. For example, a user may want a softer or more resilient setting for shaving the face or underarms and a stiffer less resilient setting for shaving the legs.

Figure 8:
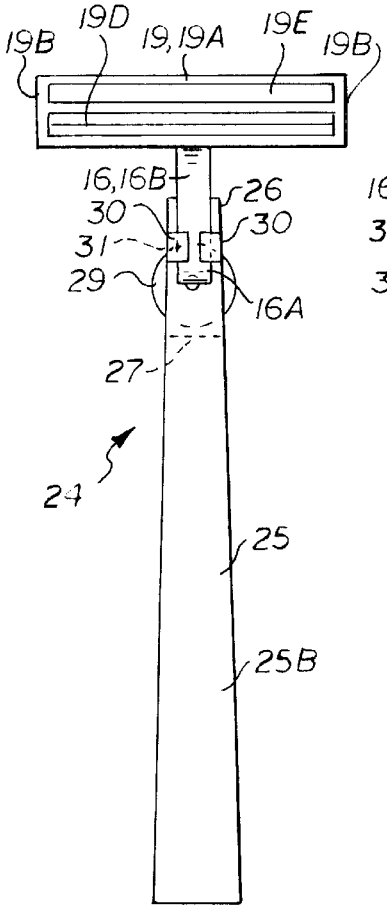
FIG. 8 is a front elevation view of the second embodiment of the adjustable razor.
Figure 7:
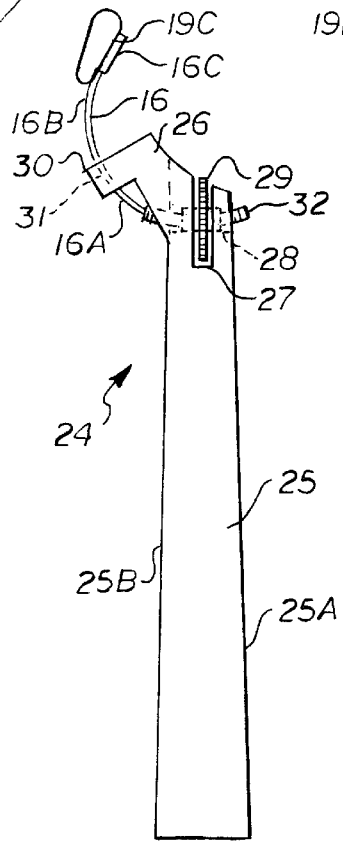
FIG. 7 is a side elevation view of a second embodiment of the adjustable razor having a thumbscrew adjustment mechanism, showing the spring member in a fully extended position.
Figure 9:
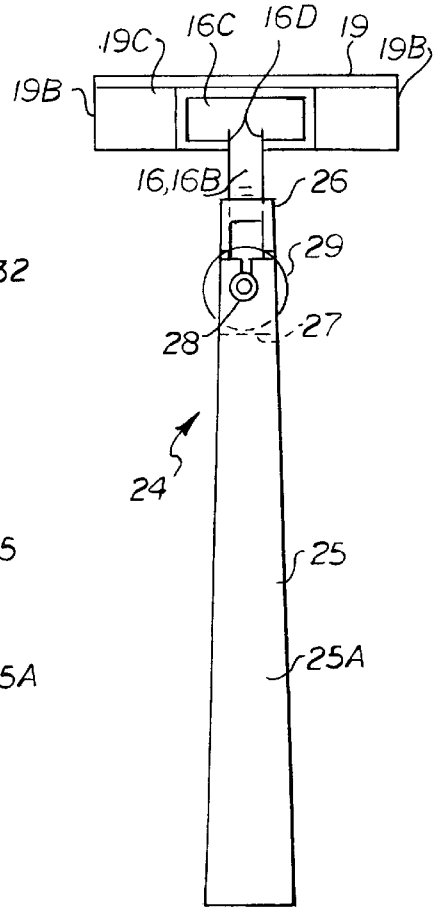
FIG. 9 is a rear elevation view of the second embodiment of the adjustable razor.

Referring now to FIGS. 7, 8 and 9, a second embodiment of the adjustable razor with a spring-supported head having a leaf spring and a thumb screw adjustment mechanism. The components in this embodiment that are substantially the same as described previously are given the same numerals of reference but their description will not be repeated to avoid repetition.

The razor 24 has an elongate rigid handle 25 which may be of any conventional shape and configuration. One end of the handle 25 has an integral generally rectangular neck portion 26 that extends outwardly from the topside 25A of the handle 25 and curves downwardly in the direction of the underside 25B of the handle. The topside 25A of the handle 25 has a transverse inwardly extending slot 27. An aperture 28 extends through the handle 25 perpendicular to the slot 27. A thumbscrew 29 which has a threaded central bore and a serrated, grooved or knurled circular outer periphery is rotatably mounted in the slot 27 and aperture 28 with segments of its circular outer periphery extending outwardly through the slot beyond the periphery of the handle 25.

A pair of generally L-shaped flanges 30 formed on the underside of the neck portion 26 near its outer end depend from the underside in laterally opposed relation with their lower legs facing inward and spaced a short distance from the underside to define a longitudinal slot 31 therebetween.

An elongated curved thin rectangular leaf spring 16 formed of resilient material having a flat cross section is movably mounted on the neck portion. The spring 16 has small diameter threaded shaft 32 secured at one end to a first end of the spring. The threaded shaft 32 extends through the thumbscrew 29 and is threadedly engaged through the central threaded bore of the thumbscrew.

As described above, the spring 16 has an elongate longitudinal curved portion 16A that is slidably received through the longitudinal slot 31 in the flange 30 on the underside of the neck portion 26, leaving a curved free end portion 16B extending outwardly therefrom. The curved free end portion 16B has a smooth uninterrupted curved surface and a central longitudinal axis extending along a curved plane, as described previously. The curved portion 16A of the spring 16 is disposed in opposed facing relation to the downwardly extending neck portion 12. The curved free end portion 16B of the spring 16 extends from the slot 31 and curves upwardly beyond the outer end of the neck portion 26.

The outermost end 16C of the free end portion 16B of the spring 16 is adapted for connection to the previously described rigid blade holding cartridge or head 19, as described above. Also as previously described, the backside 19C of the cartridge or head 19 is connected transversely at its approximate center in a plane approximately tangent to the curved plane of the free end portion 16B of the spring 16 with its lateral ends 19B extending outwardly from the sides of the spring. In a disposable razor embodiment, the flat T-shaped outer end 16C of the spring 16 may be fixed to the backside 19B of cartridge or head 19 by a bonding agent or by a heat or sonic welding procedure such that the cartridge or head becomes an integral component of the razor. In a non-disposable embodiment, a plurality of replaceable cartridges or heads 19 are provided and the T-shaped outer end 16C of the spring 16 is releasably connected to the backside of a cartridge or head.

The curved free end portion 16B is cantilevered outwardly from the slot 31 and is capable of resiliently flexing in vertical and horizontal planes and twisting along its central longitudinal axis. The resiliency of the spring 16 is adjusted by rotating the thumbscrew 29 to extend or retract the curved free end portion 16B axially relative to the neck portion 26 of the handle 25.

As described above, extending the spring 16 increases the effective length of the free end portion 16B and increases the resiliency of the spring, making it more springy, and also increases its twisting action. Retracting the spring shortens the effective length of the free end portion and decreases the resiliency, making it stiffer, and also decreases its twisting action.

The movement capability of the cartridge or head 19 is the same as described in detail above and shown in FIGS. 2, 4 and 6, and will not be described in detail here to avoid repetition.

Figure 11:
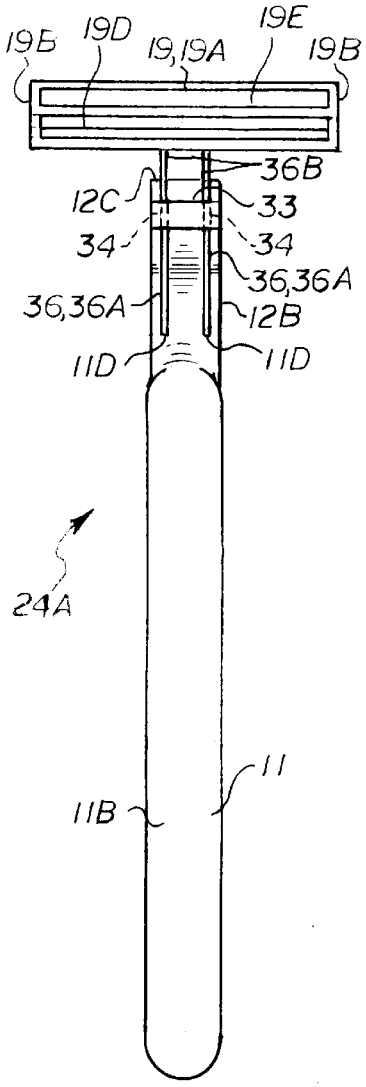
FIG. 11 is a front elevation view of the third embodiment of the adjustable razor.
Figure 10:
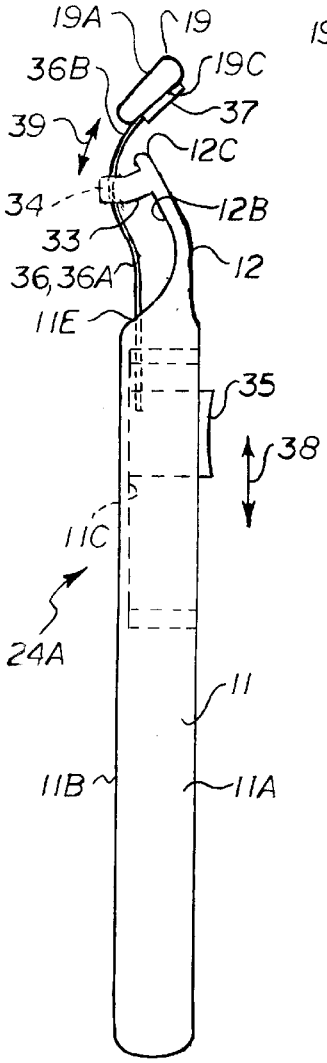
FIG. 10 is a side elevation view of a third embodiment of the adjustable razor with a spring-supported head having wire springs and a push-pull adjustment mechanism, showing the spring member in a fully extended position.
Figure 12:
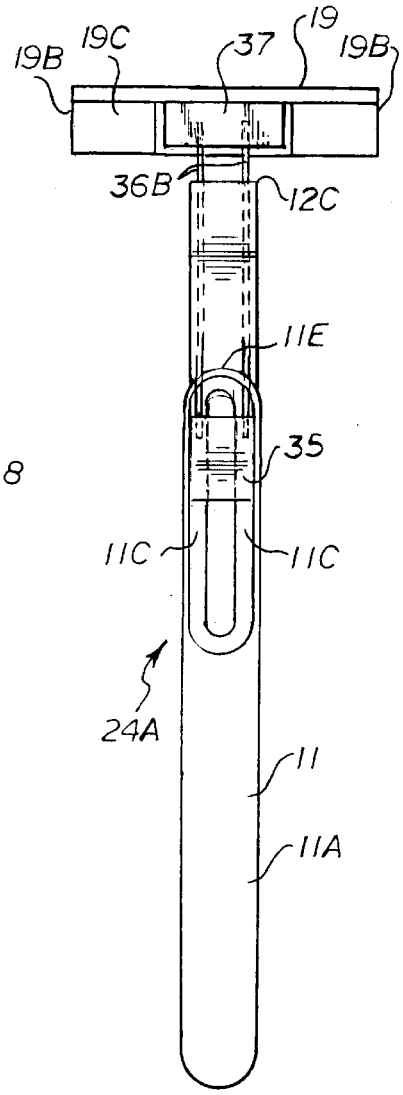
FIG. 12 is a rear elevation view of the third embodiment of the adjustable razor.

Referring now to FIGS. 10, 11 and 12, there is shown a third embodiment of the adjustable razor 24A with a spring-supported head having a pair of springs of round cross section and a push-pull adjustment mechanism. The components in this embodiment that are substantially the same as described previously are given the same numerals of reference but their description will not be repeated to avoid repetition.

This embodiment has the same type of rigid handle 11 with an integral generally rectangular curved neck portion 12 of reduced thickness that extends outwardly from the topside 11A of the handle 11 and curves downwardly in the direction of its underside 11B. A rectangular flange 33 depends from the underside 12B of the neck portion, and is provided with a pair of laterally spaced longitudinal holes 34.

A pair of laterally spaced longitudinal relatively deep channels 11C are formed in the topside 11A of the handle 11. A pair of laterally spaced holes 11D extend through the front wall 11E of the handle in axial alignment with the channels 11C. A generally saddle-shaped push-pull button 35 is slidably mounted on the handle 11 with each of its laterally spaced legs extending into a respective one of the channels 11C.

In this embodiment, a pair of springs 36 of round cross section are used rather than a leaf spring. The springs 36 may be formed of resilient plastic or metal spring wire material. The springs 36 each have an elongate longitudinal portion 36A that is slidably received though the longitudinal holes 34 in the flange 33, and a curved free end portion 36B extending outwardly therefrom. The longitudinal portions 36A extend slidably through the laterally spaced holes 11D in the front wall 11E of the handle 11 and each is secured to a respective leg of the push-pull button 35.

The curved free end portion 36B of each spring has a longitudinal axis extending along a curved plane. The outermost ends 36C of the free end portions 36B of the springs 36 are secured to a flat rectangular cross member 37 which is connected to the backside 19C of the rigid blade holding cartridge or head 19, described previously. The backside 19C of the cartridge or head 19 is connected transversely at its approximate center in a plane approximately tangent to the curved plane of the free end portions 36B of the springs 36 with its lateral ends 19B extending outwardly from the sides of each spring.

The curved free end portions 36B of the springs 36 are disposed in opposed facing relation to the downwardly extending neck portion 12 and curve upwardly beyond the outer end 12C of the neck portion 12.

The rectangular cross member 37 at the outermost end of the free end portions 36B of the springs 36 is adapted for connection to the previously described rigid blade holding cartridge or head 19, as described above. In a disposable razor embodiment, the rectangular cross member 37 may be fixed to the backside 19B of cartridge or head 19 by a bonding agent or by a heat or sonic welding procedure such that the cartridge or head becomes an integral component of the razor, or may be joined by a snap-fit arrangement. In a non-disposable embodiment, a plurality of replaceable cartridges or heads 19 are provided and the rectangular member 37 is releasably connected to the backside of a cartridge or head.

The curved free end portions 36*b* of the springs are cantilevered outwardly from the holes 34 in flange 33 and are capable of resiliently flexing in vertical and horizontal planes and twisting along a central longitudinal axis extending between them. The resiliency of the springs 36 are adjusted by moving the push-pull button 35 axially along the handle 11 to extend or retract the curved free end portions 36B axially relative to the neck portion 12 of the handle 11 as indicated by arrows 38, 39.

As described above, extending the springs 36 increases the effective length of the free end portions 36B and increases the resiliency of the springs, making them more springy, and also increases their twisting action. Retracting the springs shortens the effective length of their free end portions and decreases their resiliency, making them stiffer, and also decreases their twisting action. It should be understood that the dual spring embodiment has a greater twisting action than the leaf spring embodiment because each of the laterally spaced curved free end portions can move independently about a central longitudinal axis between them.

The movement capability of the cartridge or head 19 is the same as described in detail above and shown in FIGS. 2, 4 and 6, and will not be described in detail here to avoid repetition.

FIGS. 13 through 15 and FIGS. 16 through 18 show a first and a second embodiment, respectively, of a non-adjustable razor with a spring-supported head having a leaf spring. The components in these embodiments that are substantially the same as described previously are given the same numerals of reference but their description will not be repeated to avoid repetition.

Figure 14:
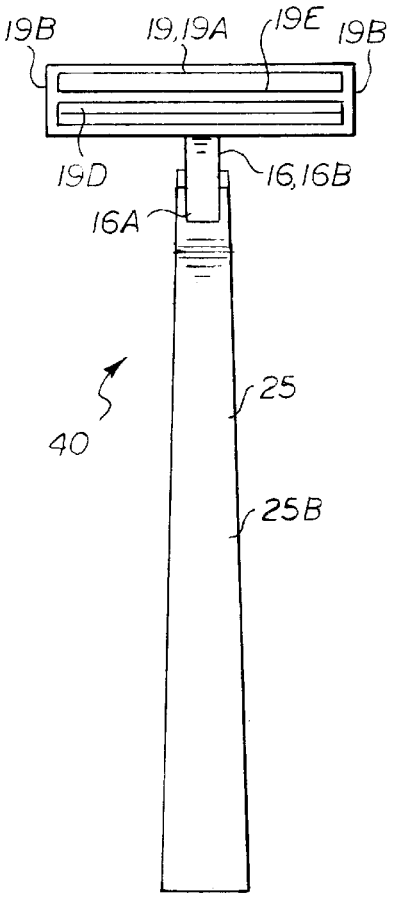
FIG. 14 is a front elevation view of the first embodiment of the non-adjustable razor.
Figure 13:
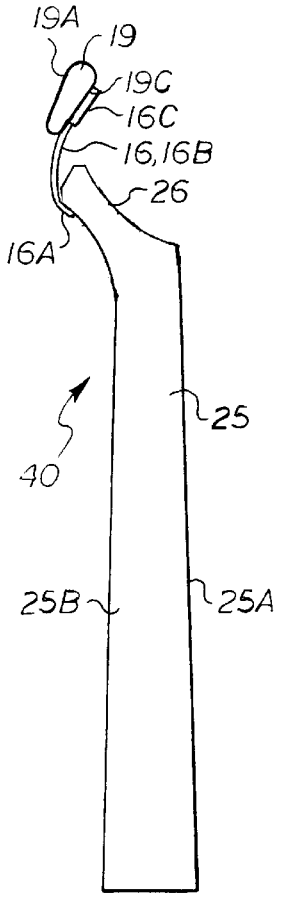
FIG. 13 is a side elevation view of a first embodiment of a non-adjustable razor with a spring-supported head in accordance with the present invention.
Figure 15:
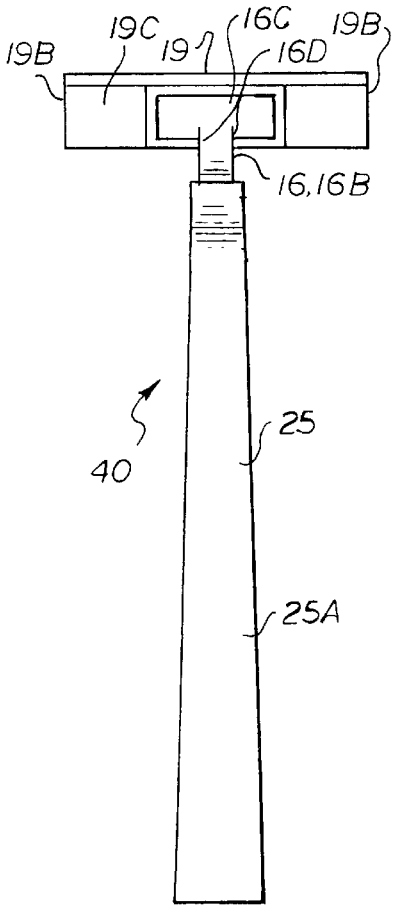
FIG. 15 is a rear elevation view of the first embodiment of the non-adjustable razor.

In the first non-disposable embodiment of FIGS. 13–15, the razor 40 has the same type type of rigid handle 25 with an integral generally rectangular neck portion 26 that extends outwardly from the topside 25A of the handle 11 and downwardly in the direction of the underside 25B of the handle, as described above in the embodiment of FIGS. 7–9.

An elongated curved thin rectangular leaf spring 16 formed of resilient material having a flat cross section is secured at a first end 16A on the underside of the neck portion 26. The first end 16A of the spring 16 may be fixed to the underside of the neck portion 26 by a bonding agent or by a heat or sonic welding procedure such that the spring becomes an integral component of the razor. The spring may also be integrally molded onto the neck during formation of the handle.

The spring 16 has a longitudinal curved free end portion 16B that extends outwardly and upwardly from the underside of the neck 26 and beyond the outer end of the neck along a curved plane disposed in opposed curved relation to the downwardly extending neck portion. In this embodiment, the outermost end 16C of the free end portion 16B of the spring 16 is a flat T-shaped configuration fixed to the backside 19B of cartridge or head 19 by a bonding agent or by a heat or sonic welding procedure such that the cartridge or head becomes an integral component of the razor. Alternatively, the handle, spring and head may be molded as an integral unit.

Figure 17:
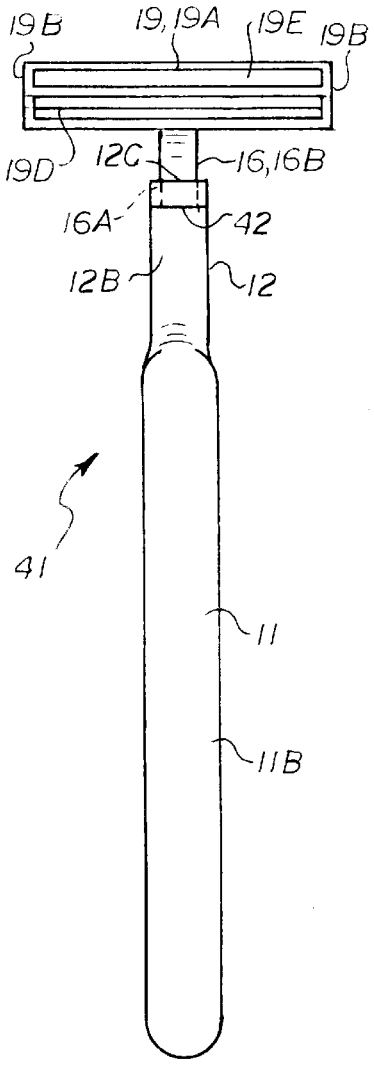
FIG. 17 is a front elevation view of the second embodiment of the non-adjustable razor.
Figure 16:
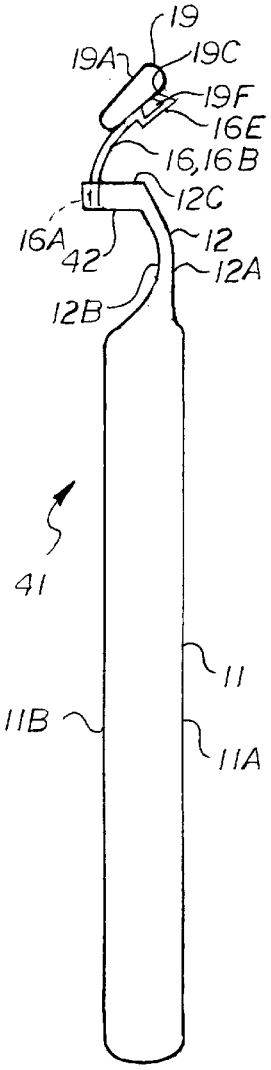
FIG. 16 is a side elevation view of a second embodiment of a non-adjustable razor with a spring-supported head in accordance with the present invention.
Figure 18:
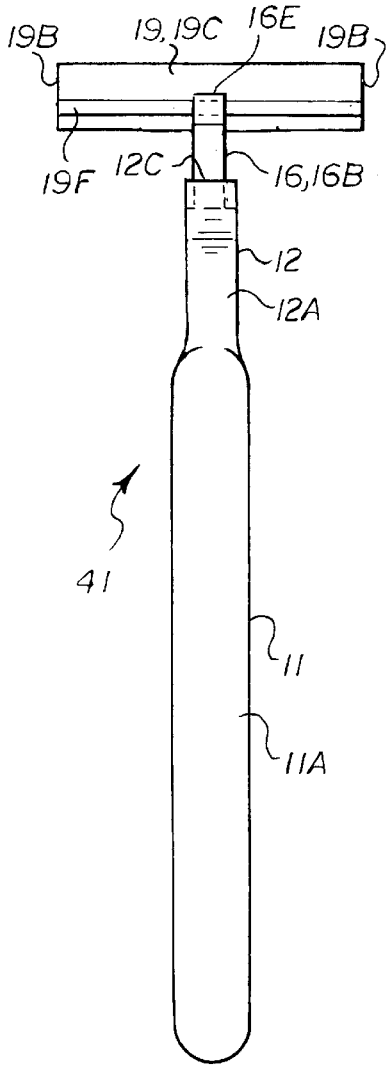
FIG. 18 is a rear elevation view of the second embodiment of the non-adjustable razor.

In the second non-disposable embodiment of FIGS. 16–18, the razor 41 has the same type of rigid handle 11 with an integral generally rectangular curved neck portion 12 of reduced thickness that extends outwardly from the topside 11A of the handle 11 and curves downwardly in the direction of the underside 11B of the handle, as described above in the embodiment of FIGS. 1–4.

An elongated curved thin rectangular leaf spring 16 formed of resilient material having a flat cross section is secured at a first end 16A on a flange 42 depending from the underside 12B of the curved neck portion 12. The first end 16A of the spring 16 may be fixed to the flange 42 by a bonding agent or by a heat or sonic welding procedure such that the spring becomes an integral component of the razor. The spring may also be integrally molded onto the flange or neck during formation of the handle.

The spring 16 has a longitudinal curved free end portion 16B that extends outwardly and upwardly from the underside of the neck portion 12 and beyond the outer end 12C of the neck along a curved plane disposed in opposed facing relation to the downwardly extending neck portion 12, and terminates in an outermost end 16E.

The outermost end 16E is adapted for connection to a rigid blade holding cartridge or head 19, similar to that described above. In this embodiment, the backside 19C of the cartridge or head 19 has an upstanding longitudinal wedge shaped rib 19F and the outermost end 16E of the spring 16 is formed into a mating transverse wedge-shaped slot which is releasably connected to the rib on the backside of the cartridge or head. The outermost end 16E of the spring 16 is releasably connected to the backside 19C of the cartridge or head 19 by a sliding-fit or a snap-fit connection.

Figure 19:
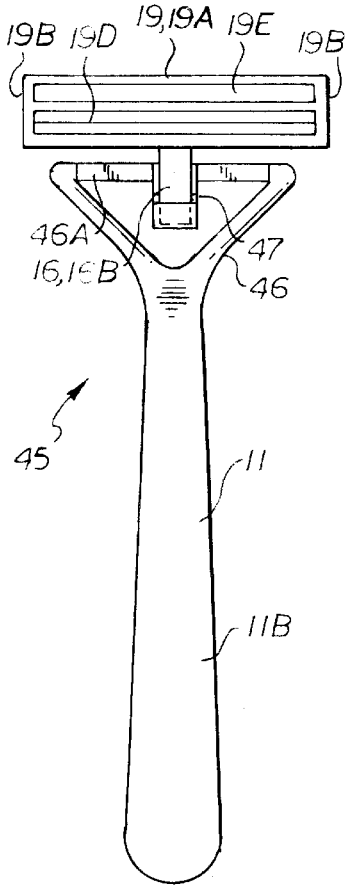
FIG. 19 is a front elevation view of a third embodiment of a non-adjustable razor with a spring supported in a clip attached to the neck portion of the razor handle.
Figure 20:
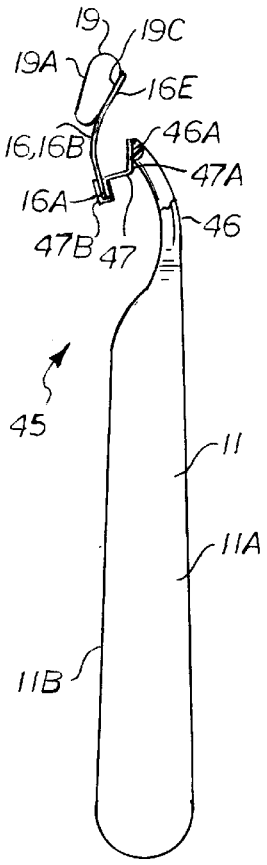
FIG. 20 is a side elevation view of the third embodiment of the non-adjustable razor, with a portion of the neck portion broken away to more clearly show the clip.
Figure 21:
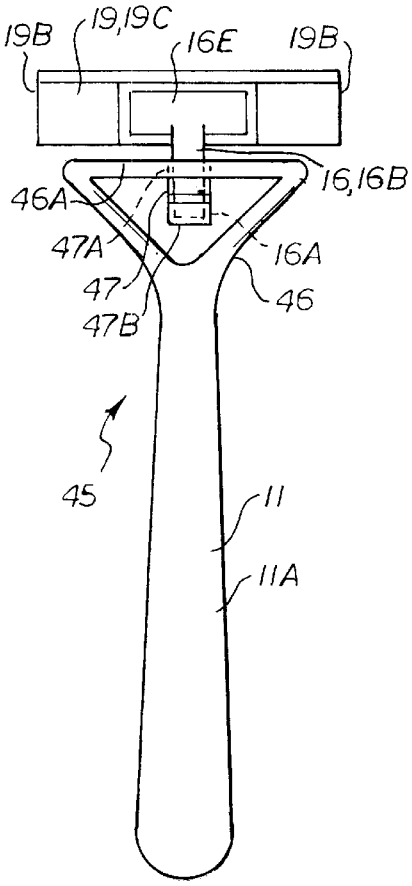
FIG. 21 is a rear elevation view of the third embodiment of the non-adjustable razor.

FIGS. 19–21 show a third embodiment of a non-adjustable razor 45 with a spring supported in a clip attached to the neck portion of the razor handle 11. In this embodiment, the neck portion 46 of the handle 11 is a triangular configuration with resilient clip element 47 secured at one end 47A to the horizontal leg 46A of the triangular neck portion by a bonding agent or by a heat or sonic welding procedure.

The clip 47 extends outwardly and downwardly from the horizontal leg 46A of the triangular neck portion 46 and terminates in a second end 47B. A curved thin rectangular leaf spring 16 formed of resilient material having a flat cross section is secured at a first end 16A to the second end 47B of the clip 47. The spring 16 has a longitudinal curved free end portion 16B that extends outwardly and upwardly from the clip 47 and beyond the neck portion 46 along a curved plane and terminates in an outermost end 16E which is adapted for connection to a rigid blade holding cartridge or head 19, as described above. The components in this embodiment that are substantially the same as described previously are given the same numerals of reference but their description will not be repeated to avoid repetition.

Figure 22:
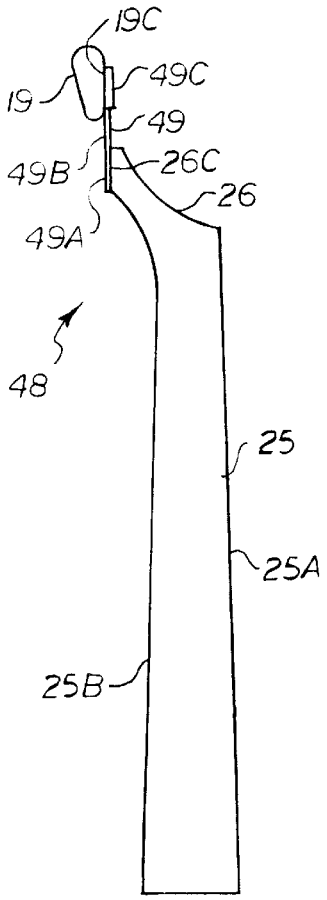
FIG. 22 is a side elevation view of an embodiment of the non-adjustable razor having a straight spring secured on the neck portion of the razor handle.

FIG. 22 shows an embodiment of the non-adjustable razor 48 having a straight spring 49 secured on the neck portion of the razor handle. In the illustrated example, the handle 25 is similar to the handle of FIGS. 7–9 and 13–15 and the handle features are assigned the same numerals of reference.

In this embodiment, the razor 48 has the same type of rigid handle 25 with an integral generally rectangular neck portion 26 that extends outwardly from the topside 25A of the handle 11 and downwardly in the direction of the underside 25B of the handle, as described above in the embodiment of FIGS. 7–9.

A thin generally rectangular leaf spring 49 formed of resilient material having a flat cross section is secured at a first end 49A on a flat surface 26C of the neck portion 26 by a bonding agent or by a heat or sonic welding procedure. The spring may also be integrally molded onto the neck during formation of the handle.

The spring 49 has a longitudinal portion 49B that extends outwardly from neck portion 26 and terminates in an outermost end 49C fixed to the backside 19C of the cartridge or head 19 by a bonding agent or by a heat or sonic welding procedure such that the cartridge or head becomes an integral component of the razor. Alternatively, the handle, spring and head may be molded as an integral unit.

In the non-adjustable embodiments of FIGS. 13–22 the free end portion 16B of the spring 16 or longitudinal portion 49B of the spring 49 is cantilevered outwardly from the neck portion of the handle and is capable of resiliently flexing in vertical and horizontal planes and twisting along its central longitudinal axis. In the non-adjustable embodiments, the resiliency of the spring cannot be adjusted, but the non-adjustable razors may be produced as a line of razors with springs of different resiliency.

With the exception of the adjustment feature for extending and retracting the spring 16 or 49 and head or cartridge 19, the movement capability of the cartridge or head 19 of the non-adjustable embodiments is the same as described in detail above and shown in FIGS. 2, 4 and 6, and will not be described in detail here to avoid repetition.

Figure 23:
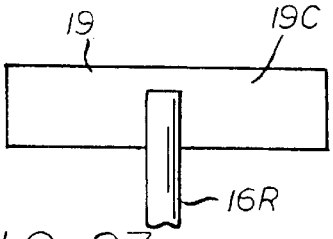
FIG. 23 is a rear elevation view of a single spring having a round cross section secured to the back end of the razor head.

FIG. 23 is a rear elevation view of a single spring 16R having a round cross section secured to the back end 19C of the razor head 19.

Figure 24:
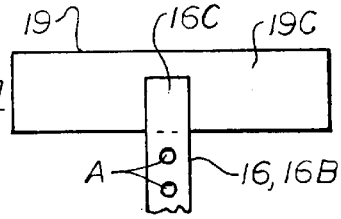
FIGS. 24 through 26 are rear elevations and FIG. 27 is a side elevation of the razor head showing various modifications of the longitudinal portion of the spring to increase its flexibility.
Figure 25:
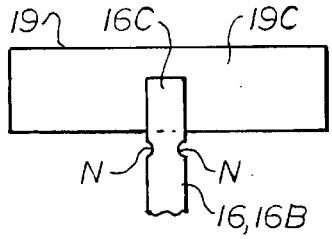
Figure 26:
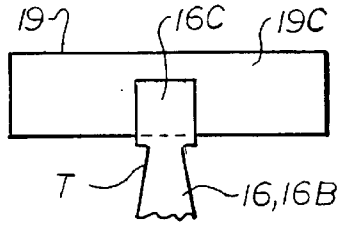
Figure 27:
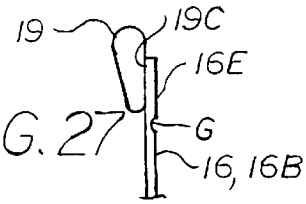

FIGS. 24 through 26 are rear elevations and FIG. 27 is a side elevation of the razor head 19 showing various modifications of the longitudinal portion 16B of the spring 16 to increase its flexibility. In FIG. 24 the longitudinal portion 16B is provided with one or more apertures A. In FIG. 25 the lateral sides of the longitudinal portion 16B is provided with one or more notches N. In FIG. 26 the lateral sides of the longitudinal portion 16B are tapered T. In FIG. 27 the longitudinal portion 16B is provided with a transverse shallow groove G.

Figure 28:
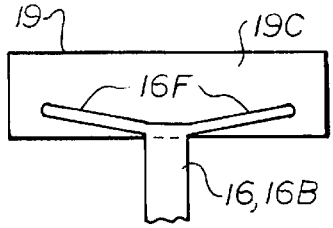
FIGS. 28 and 29 are rear elevations of the razor head showing various methods of attaching the outermost end of the spring to the back side of the razor head.
Figure 29:
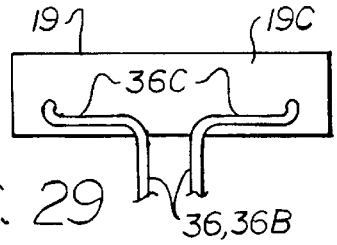

FIGS. 28 and 29 are rear elevations of the razor head 19 showing various methods of attaching the outermost end of the spring 16C to the back side 19C of the razor head. In FIG. 28 the outermost end 16C of the flat spring 16 is provided with a pair of laterally opposed arms 16F that are secured at their outer ends to the back side 19C of the razor head 19. FIG. 29 shows a modification of the pair of springs 36 of round cross section (FIGS. 11–12) wherein the springs each have an upper end 36C that extends laterally outward in opposed relation and are secured at their outer ends to the back side 19C of the razor head 19.

Figure 30:
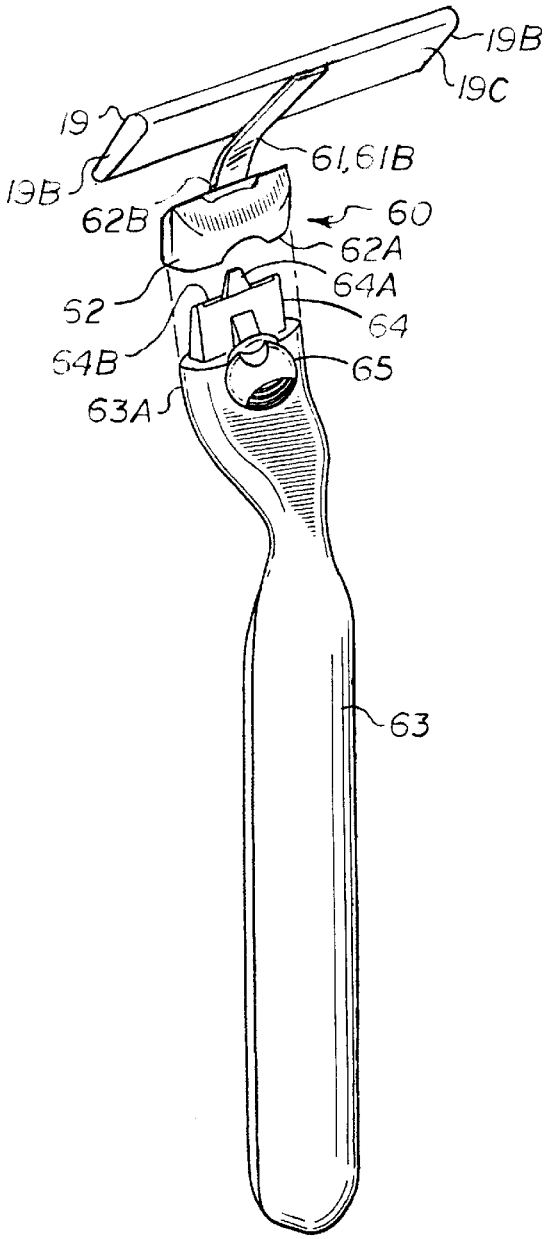
FIGS. 30 and 31 are front and rear perspective views, respectively, of a spring head assembly for attachment to the neck portion of an existing handle of a non-motorized hand-held razor.
Figure 31:
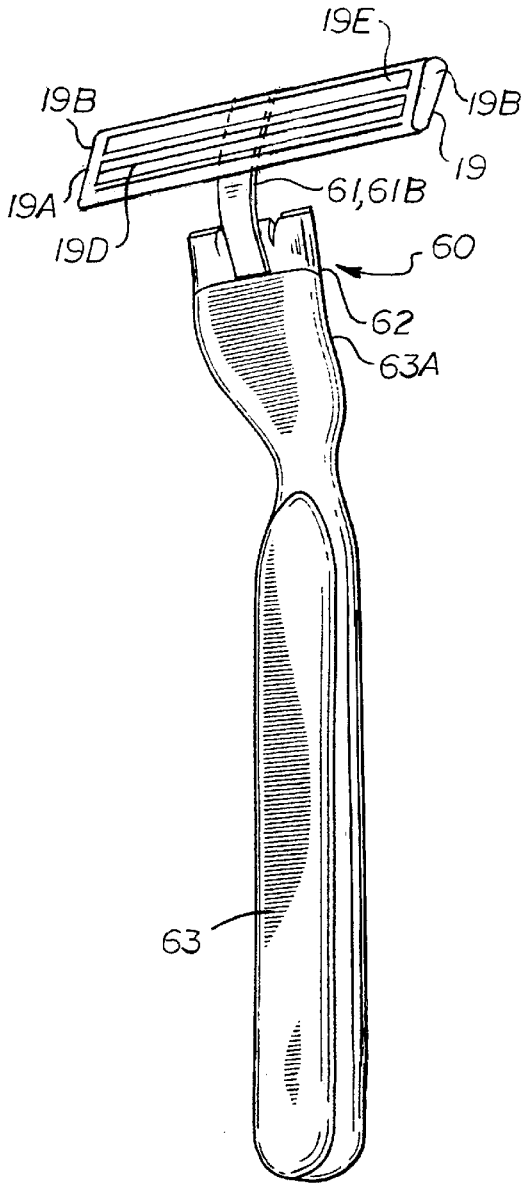

FIGS. 30 and 31 show a spring head assembly 60 for attachment to the neck portion of an existing handle of a non-motorized hand-held razor. The assembly includes a generally rectangular razor head 19 having a longitudinal front side 19A with one or more razor blades 19D mounted thereon, lateral ends 19B, and a longitudinal back side 19C. The head 19 may also be provided with a conventional lubricating strip 19E of lubricous material adjacent to the blades. The backside 19C of the cartridge or head 19 is connected transversely at its approximate center in a plane approximately tangent to the curved plane of the free end portion of the spring 61 with its lateral ends 19B extending outwardly from the sides of the spring.

A thin flat generally rectangular resilient spring 61 is secured at a first end 61A to a neck adapter 62 that is configured to be connected to the neck portion of an existing handle 63. The spring 61 has a mid portion extending outwardly from its first end along a longitudinal central axis and has a second end connected at the approximate center of the back side 19C of the razor head 19. The razor blades 19D mounted on the front side 19A of the razor head are resiliently biased against the skin surface and pulled thereacross. The longitudinal mid portion 61B of the spring 61 may be straight or curved, as previously described.

As with the previous embodiments, the spring member mid portion 61B is resiliently flexible in vertical and horizontal planes and capable of twisting along its central longitudinal axis to enable spring-biased movement of the razor head 19 with the spring mid portion in arcuate vertical and horizontal paths relative to a longitudinal axis of the handle, and spring-biased twisting movement of the razor head lateral ends in diametrically opposed arcuate paths about the mid portion central longitudinal axis and the handle longitudinal axis.

By way of example, but not limited thereto, the neck adapter 62 is configured to be releasably connected to the handle 63 of a razor such as that shown and described in detail in U.S. Pat. Nos. 5,784,790 and 5,787,586 which are hereby incorporated by reference as if fully set forth in their entirety herein. Such razors are marketed by The Gillette Company under the trademark of "Mach 3". The neck portion 63A of the handle 63 has a trapezoid shaped extension 64 which contains a spring biased plunger 64A and a U-shaped ejector member (not shown) that are received within a recess 64B of the extension. An ejector button 65 is received in an opening 65A on the top surface of the neck portion 63A and is interconnected with the ejector member.

The illustrated example of the present neck adapter 62 is a generally rectangular member with an opening 62A at one end which is shaped to receive the trapezoid shaped extension 64 and an opening 62B at the opposite end through which the spring-biased plunger 64A of the extension 64 passes. The interior of the neck adapter 62 has a pair of resilient lugs that snap into depressions on the underside of the extension 64 (not shown) when it is pressed onto the extension to releasably retain the neck adapter on the extension 64. When the ejector button 65 is pressed downward, the legs of the U-shaped ejector member in the extension 64 are extended forwardly to engage the end of the neck adapter 62 to unseat the resilient lugs from the depressions and eject the neck adapter from the extension.

Figure 32:
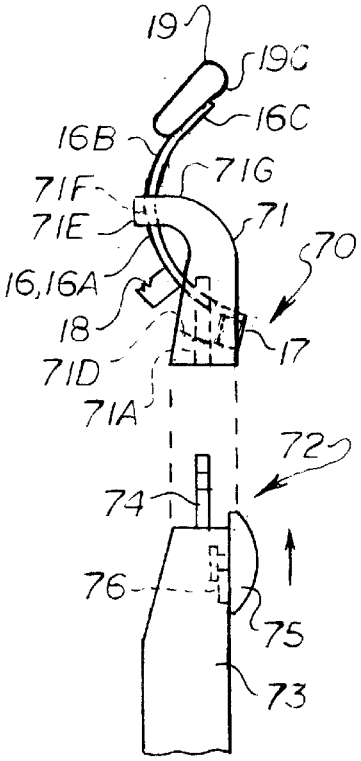
FIGS. 32 and 33 are partial front and rear elevation views, respectively, of an adjustable embodiment of a spring head assembly for attachment to the neck portion of a handle of a non-motorized hand-held razor.
Figure 33:
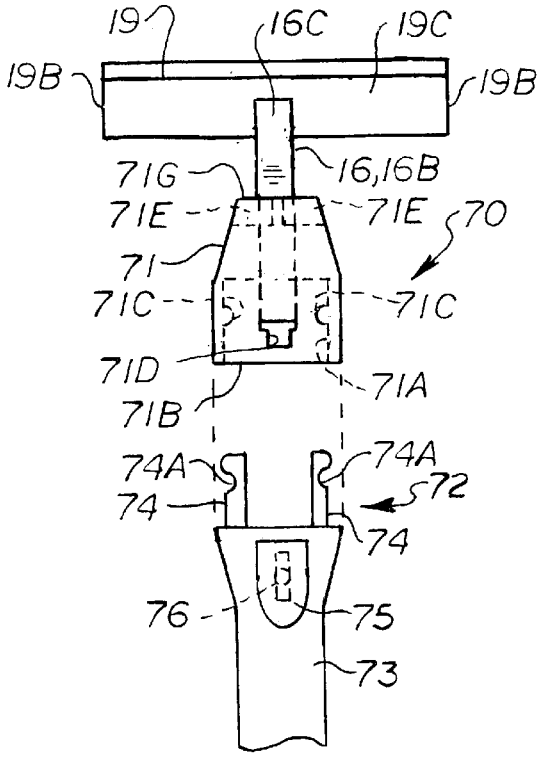

FIGS. 32 and 33 show an adjustable embodiment of a spring head assembly 70 having a neck adapter 71 that can be releasably attached to the neck portion 72 of a handle 73 of a non-motorized hand-held razor. In the illustrated example, but not limited thereto, the neck adapter 71 has a generally rectangular cavity 71A that extends inwardly from its back end 71B. A pair of inwardly opposed facing protuberances 71C are formed on the interior of the lateral side walls of the cavity 71A. The neck portion 72 of the handle 73 has a forwardly extending pair of resilient laterally spaced parallel arms 74 each with a recess 74A on its outer side.

The neck adapter 71 is installed on the handle 73 by placing it on the arms 74 and pressing it toward the handle. As the adapter 71 moves toward the handle 73, the arms 74 will be resiliently biased inwardly until the recesses 74A become aligned with the protuberances 71C at which time they snap into engagement therewith to retain the adapter 71 on the neck portion of the handle. A release button 75 is slidably mounted in a slot 76 on the top side of the handle 73. To release the spring head assembly 70, the release button 75 is pressed forward to engage the back end 71B of the neck adapter 71. As the adapter 71 is urged away from the handle 73, the arms 74 will be resiliently biased inwardly until the recesses 74A become disengaged from the protuberances 71C and the adapter will be ejected from the arms.

A polygonal slot 71D extends through the front and rear surfaces of the neck adapter 71. A pair of generally L-shaped flanges 71E formed on the underside of the neck adapter 71 at its outer end depend from the underside in laterally opposed relation with their lower legs facing inward and spaced a short distance therefrom to define a longitudinal slot 71F therebetween.

An elongated curved thin rectangular leaf spring 16 formed of resilient material having a flat cross section is movably mounted on the neck adapter 71. The curved spring may be formed of any suitable resilient material such as plastic or metal. The spring 16 has an elongate longitudinal curved portion 16A that is slidably received though the longitudinal slot 71F defined by the flanges 71E, leaving a curved free end portion 16B extending outwardly therefrom. The curved free end portion 16B has a smooth uninterrupted curved surface and a central longitudinal axis extending along a curved plane.

A first small rectangular push element 17 is disposed on the underside of the spring 16 at a first end of the spring. A second small rectangular push element 18 is disposed on the underside of the spring 16 in longitudinally spaced relation a short distance from the first push element 17.

In a preferred embodiment, the thin leaf spring 16 is approximately 3/16" in width and the width of the push elements 17 and 18 are more narrow to define a generally T-shaped cross section at the first end of the spring. The polygonal slot 71D extending through the neck adapter 71 is a mating T-shaped channel sized to slidably receive the T-shaped spring 16 and depending push elements 17 and 18. It should be understood, however, that the cross sectional shape formed by the first end of the spring 16 and push elements 17 and 18 and the mating slot 17D may be any suitable configuration to prevent rotation of the portion of the spring extending between the slots 71F and 71D. For example, they may be square or rectangular or may be provide mating slots and grooves.

The push elements 17 and 18 are spaced apart a sufficient distance so that when the spring is in its fully extended position the first push element 17 will be generally flush with the topside of the neck adapter 71 with the second push element 18 protruding from the neck adapter underside, and when the spring is fully extended the second push element 18 will be generally flush with the underside of the neck adapter with the first push element 17 protruding from the topside of the neck adapter. It should be understood that a single elongate push element may be used wherein its outer ends would alternately protrude or be generally flush as the spring is extended and retracted.

The curved free end portion 16B of the spring 16 extends from the slot 71F in the flanges 71E, curves upwardly beyond the outer end 71G of the neck adapter 71, and terminates in an outermost end 16C. The outermost end 16C of the spring 16 is secured to the back side 19C of a rigid blade holding cartridge or head 19. The backside 19C of the cartridge or head 19 is connected transversely at its approximate center in a plane approximately tangent to the curved plane of the free end portion 16B of the spring 16 with its lateral ends 19B extending outwardly from the sides of the spring.

As with the previous embodiments, the spring member mid portion 16B is resiliently flexible in vertical and horizontal planes and capable of twisting along its central longitudinal axis to enable spring-biased movement of the razor head 19 with the spring mid portion in arcuate vertical and horizontal paths relative to a longitudinal axis of the handle, and spring-biased twisting movement of the razor head lateral ends in diametrically opposed arcuate paths about the mid portion central longitudinal axis and the handle longitudinal axis.

While this invention has been described fully and completely with special emphasis upon preferred embodiments, it should be understood that within the scope of the appended claims the invention may be practiced otherwise than as specifically described herein.

I claim:

1. A non-motorized hand-held razor comprising:

a handle by which the razor can be gripped and manipulated when shaving hair from a skin surface, said handle having a longitudinal axis and a neck portion at one end thereof;

a single thin generally rectangular resilient spring member of flat cross section supported at a first end thereof on said handle neck portion and having a free end portion extending outwardly therefrom along a longitudinal central axis and terminating in a second end; and a generally rectangular razor head having a longitudinal front side with a razor blade mounted thereon, lateral ends, and a longitudinal back side attached and supported transversely at its approximate center on, and approximately tangent with, said spring member second end and its said lateral ends extending unsupported laterally outward from the point of attachment with said second end;

said spring member free end portion being resiliently flexible in vertical and horizontal planes and capable of twisting along said longitudinal central axis to enable spring-biased movement of said razor head with said free end portion in arcuate vertical and horizontal paths relative to said handle longitudinal axis, and spring-biased twisting movement of said razor head lateral ends in diametrically opposed arcuate paths about said free end portion longitudinal central axis and said handle longitudinal axis.

2. The hand-held razor according to claim 1, wherein said free end portion of said resilient spring member is a smooth uninterrupted curved portion extending outwardly from said handle neck portion with its said longitudinal central axis extending along a curved plane; and said razor head longitudinal back side is attached transversely at its approximate center on said spring member second end in a plane approximately tangent to the convex portion of said curved plane of said spring member curved free end portion with its lateral ends extending laterally outwardly therefrom.

3. The hand-held razor according to claim 2, wherein said free end portion of said resilient spring member extends outwardly from said handle neck portion with its said longitudinal central axis extending along a curved plane bowed outwardly relative to said handle longitudinal axis in a forward direction that said head will travel when shaving; such that said razor blade mounted on said razor head longitudinal front side is resiliently biased against the skin surface and pulled across the skin surface.

4. The hand-held razor according to claim 1, wherein said rectangular razor head longitudinal back side is releasably attached on said spring member second end.

5. The hand-held razor according to claim 1, further comprising:

adjustment means disposed between said handle and said resilient spring member first end for selectively extending and retracting said resilient spring member free end portion relative to said handle to increase or decrease the effective length and resiliency of said resilient spring member free end portion; such that extending said free end portion increases the resilient spring action and twisting action of said spring member and movement of said head, and retracting said free end portion decreases the resilient spring action and twisting action of said spring member and said head.

6. The hand-held razor according to claim 5, wherein said spring member extends slidably through a support surface on said handle neck portion and its said free end portion extends outwardly from said support surface; and said adjustment means is connected with said resilient spring member first end for slidably extending and retracting said free end portion relative to said support surface.

7. The hand-held razor according to claim 6, wherein said adjustment means comprises longitudinally spaced first and second surfaces on said spring member first end;

said first surface when pushed to a position generally flush with a top side of said neck portion extending said spring member to a fully extended position causing said second surface to protrude from a bottom side of said neck portion; and said second surface when pushed to a position generally flush with said neck portion bottom side retracting said spring member and causing said first surface to protrude from said neck portion top side.

8. The hand-held razor according to claim 6, wherein said adjustment means comprises a slide member slidably mounted on said handle for axial movement relative thereto;

said slide member when pushed toward said neck portion extending said spring member, and when pulled away from said neck portion retracting said spring member.

9. The hand-held razor according to claim 6, wherein said adjustment means comprises a thumbscrew rotatably mounted on said handle and operatively connected with said spring member first end;

said thumbscrew when rotated in a first direction extending said spring member, and when rotated in a second direction retracting said spring member.

10. The hand-held razor according to claim 1, wherein said free end portion of said resilient spring member is a straight portion extending outwardly from said handle neck portion and having a longitudinal central axis extending along a straight plane; and said razor head longitudinal back side is attached transversely at its approximate center on said spring member second end in a plane approximately tangent to the straight plane of said spring member free end portion with its lateral ends extending laterally outwardly therefrom.

11. A non-motorized hand-held razor comprising:

a handle by which the razor can be gripped and manipulated when shaving hair from a skin surface, said handle having a longitudinal axis and a neck portion at one end thereof;

two laterally spaced resilient spring members each supported at a first end thereof on said handle neck portion and each having a free end portion extending outwardly therefrom along a longitudinal central axis and terminating in a second end; and a generally rectangular razor head having a longitudinal front side with a razor blade mounted thereon, lateral ends, and a longitudinal back side attached and supported transversely at its approximate center on, and approximately tangent with, each said spring member second end and its said lateral ends extending unsupported laterally outward from the points of attachment with said second ends;

each said spring member free end portion being resiliently flexible in vertical and horizontal planes and capable of relative twisting movement to enable spring-biased movement of said razor head with said free end portion in arcuate vertical and horizontal paths relative to said handle longitudinal axis, and spring-biased twisting movement of said razor head lateral ends in diametrically opposed arcuate paths about said free end portion longitudinal central axis and said handle longitudinal axis.

12. The hand-held razor according to claim 11, wherein each said free end portion of said resilient spring members is a smooth curved portion extending outwardly from said handle neck portion with its said longitudinal central axis extending along a curved plane; and said razor head longitudinal back side is attached transversely at its approximate center on each said spring member second end in a plane approximately tangent to the convex portion of said curved plane of said curved free end portion with its lateral ends extending laterally outwardly therefrom.

13. The hand-held razor according to claim 12, wherein each said free end portion of said resilient spring members extends outwardly from said handle neck portion with its said longitudinal central axis extending along a curved plane bowed outwardly relative to said handle longitudinal axis in a forward direction that said head will travel when shaving; such that said razor blade mounted on said razor head longitudinal front side is resiliently biased against the skin surface and pulled across the skin surface.

14. The hand-held razor according to claim 11, wherein said rectangular razor head longitudinal back side is releasably attached on said second end of said laterally spaced spring members.

15. The hand-held razor according to claim 11, further comprising:

adjustment means disposed between said handle and each said resilient spring member first end for selectively extending and retracting said free end portions of said resilient spring members relative to said handle to increase or decrease the effective length and resiliency of said free end portions; such that extending said free end portions increases the resilient spring action and twisting action of each said spring member and movement of said head, and retracting said free end portions decreases the resilient spring action and twisting action of said spring members and said head.

16. The hand-held razor according to claim 15, wherein each said spring member extends slidably through a support surface on said handle neck portion and its said free end portion extends outwardly from said support surface; and said adjustment means is connected with said first end of each said resilient spring member for slidably extending and retracting said free end portion relative to said support surface.

17. The hand-held razor according to claim 11, wherein said free end portion of each of said resilient spring members is a straight portion extending outwardly from said handle neck portion and having a central longitudinal axis extending along a straight plane; and said razor head longitudinal back side is attached transversely at its approximate center on said second ends of said spring members in a plane approximately tangent to the straight plane of said free end portion with its lateral ends extending laterally outwardly therefrom.

18. A spring head assembly for attachment to a neck portion of a handle of a non-motorized hand-held razor, comprising:

a generally rectangular razor head having a longitudinal front side with a razor blade mounted thereon, lateral ends, and a longitudinal back side;

a neck adapter configured to be connected to said neck portion of said handle;

at least one resilient spring member having a first end connected to said neck adapter and having a mid portion extending outwardly therefrom along a longitudinal central axis and having a second end connected at the approximate center of said razor head longitudinal back side; whereby said razor blade mounted on said razor head longitudinal front side is resiliently biased against a skin surface and pulled across the skin surface; and said spring member mid portion is resiliently flexible in vertical and horizontal planes and capable of twisting along its said longitudinal central axis to enable spring-biased movement of said razor head with said mid portion in arcuate vertical and horizontal paths relative to a longitudinal axis of said handle, and spring-biased twisting movement of said razor head lateral ends in diametrically opposed arcuate paths about said mid portion longitudinal central axis and said handle longitudinal axis.

19. The spring head assembly hand-held razor according to claim 18, wherein said mid portion of said resilient spring member is a smooth uninterrupted curved portion extending outwardly from said handle neck portion with its said longitudinal central axis extending along a curved plane; and said razor head longitudinal back side is attached transversely at its approximate center on said spring member second end in a plane approximately tangent to the convex portion of said curved plane of said spring member curved mid portion with its lateral ends extending laterally outwardly therefrom.

20. The spring head assembly according to claim 18, further comprising:

adjustment means disposed between said neck adapter and said resilient spring member first end for selectively extending and retracting said resilient spring member mid portion relative to said neck adapter to increase or decrease the effective length and resiliency of said resilient spring member mid portion; such that extending said mid portion increases the resilient spring action and twisting action of said spring member and movement of said head, and retracting said mid portion decreases the resilient spring action and twisting action of said spring member and said head.

21. A non-motorized hand-held razor comprising:

a handle by which the razor can be gripped and manipulated when shaving hair from a skin surface, said handle having a longitudinal axis and a neck portion at one end thereof;

a single thin resilient spring member of circular cross section supported at a first end thereof on said handle neck portion and having a free end portion extending outwardly therefrom along a longitudinal central axis and terminating in a second end; and a generally rectangular razor head having a longitudinal front side with a razor blade mounted thereon, lateral ends, and a longitudinal back side attached and supported transversely at its approximate center on, and approximately tangent with, said spring member second end with its said lateral ends extending unsupported laterally outward from the point of attachment with said second end;

said spring member free end portion being resiliently flexible in vertical and horizontal planes and capable of twisting along its said longitudinal central axis to enable spring-biased movement of said razor head with said free end portion in arcuate vertical and horizontal paths relative to said handle longitudinal axis, and spring-biased twisting movement of said razor head lateral ends in diametrically opposed arcuate paths about said free end portion longitudinal central axis and said handle longitudinal axis.

* * * * *